United States Patent [19]

Anderson

[11] 3,930,784

[45] Jan. 6, 1976

[54] PHOTOFLASH LAMP HAVING NON-SHORTING CONSTRUCTION

[75] Inventor: Robert M. Anderson, Pepper Pike, Ohio

[73] Assignee: General Electric Company, Schenectady, N.Y.

[22] Filed: Dec. 19, 1974

[21] Appl. No.: 534,904

[52] U.S. Cl. ..... 431/93; 431/95

[51] Int. Cl.[2] ..... F21K 5/02

[58] Field of Search ..... 431/93–95

[56] References Cited

UNITED STATES PATENTS

| | | | |
|---|---|---|---|
| 2,201,294 | 5/1940 | Kreidler | 431/93 |
| 3,706,522 | 12/1972 | Shaffer | 431/93 |
| 3,816,054 | 6/1974 | Baldrige, Jr. et al. | 431/95 |

*Primary Examiner*—William E. Wayner
*Assistant Examiner*—William E. Tapolcai, Jr.
*Attorney, Agent, or Firm*—Norman C. Fulmer; Lawrence R. Kempton; Frank L. Neuhauser

[57] ABSTRACT

Beads of glass or plastic are placed around the lead-in wires in the bottom part of a flash lamp. This prevents metal debris in a flashed lamp from electrically shorting across the lead-in wires at the bottom of the lamp.

14 Claims, 4 Drawing Figures

PHOTOFLASH LAMP HAVING NON-SHORTING CONSTRUCTION

BACKGROUND OF THE INVENTION

The invention is in the field of photoflash lamps of the type having a pair of lead-in wires carrying a filament or other electrical ignition means inside a bulb containing combustible material such as shredded metal foil and a combustion-supporting gas such as oxygen.

Flash lamps are conventionally constructed with a pair of lead-in wires extending through a seal region at the bottom of the bulb. If strands of the shredded foil in the lamp should short across the lead-in wires, it may be impossible to flash the lamp, especially in the case of a high voltage type of lamp. Cameras and other apparatus for using flash lamps are arranged to normally position the lamps base-down when they are flashed, so that the hot burning metal particles will fall down onto the relatively thick seal region of the bulb and will be less likely to cause cracking of the bulb and explosion of the lamp than if they were to fall against the relatively thin sides or top of the bulb. Occasionally incompletely burned particles of metal (from either or both of the shredded foil and the lead-in wires) fall to the bottom of the bulb and cause shorts, or partial shorts, across the lead-in wires. This is undesirable because the shorted or partially shorted lamp draws and wastes electrical energy from the battery or other source of firing voltage. Also, certain electrical circuits which sequentially flash the lamps of a flash array such as the FlashBAr array, now commercially available, require that the lamps have an open circuit, or at least a relatively high impedance compared to that of an unflashed lamp, internally across their lead-in wires after being flashed in order that the circuit can function to flash the next lamp in the array.

U.S. Pat. No. 3,816,054 to Baldrige and Sobieski discloses a flash lamp construction having a glass sleeve around one of the lead-in wires for reducing the likelihood of after-flash shorting. Another known technique for reducing the likelihood of shorting, both before and after flashing, is to enclose the lead-in wires with glass extending from the bottom of the bulb.

SUMMARY OF THE INVENTION

Objects of the invention are to provide improved photoflash lamps, and to provide photoflash lamps which will almost invariably have an open circuit or high impedance both before and after being flashed.

The invention comprises, briefly and in a preferred embodiment, a photoflash lamp of the type having a pair of lead-in wires extending through the base of a bulb containing combustible metal and a combustion-supporting gas, there being a filament or other flash ignition means connected across the lead-in wires within the bulb. A glass bead may be sealed to the lead-in wires to hold them correctly spaced apart in the bulb. In accordance with the invention, small beads of glass or plastic or other electrically insulative material are positioned around at least one of the lead-in wires near the bottom of the bulb, and they function to prevent remanents of incompletely burned metal particles from causing shorts between the lead-in wires. The beads, which may be spherical in shape and either solid or hollow, can be poured into the bulb after the lead-in wire assembly has been sealed to the bottom of the bulb, and then the shredded foil combustible metal is placed in the bulb over the beads and functions to hold the beads in place in the lower portion of the bulb. Alternatively, a binder material can be mixed with or poured onto the beads to hold them in place. Although the plurality of beads displaces some of the volume in the bulb which would otherwise be usefully occupied by oxygen, they do not displace as much volume as would a solid mass of material, because the oxygen can occupy the spaces between and among the beads. If the beads are hollow and are provided with openings through their walls, their displacement of oxygen space is reduced. This can also be accomplished by making the beads in the shape of hollow hemispheres or other cup-like configurations.

DESCRIPTION OF THE PREFERRED EMBODIMENTS

Figure 1:
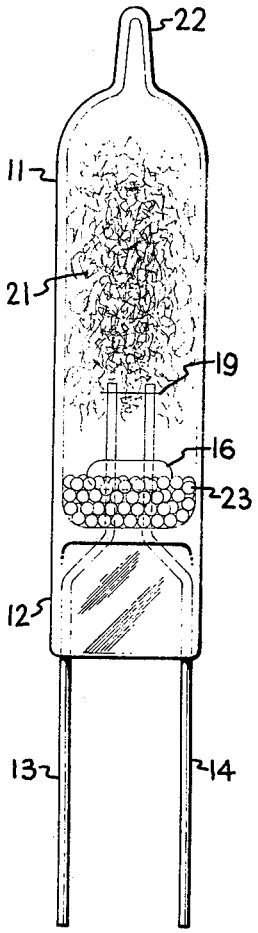
FIG. 1 is a side view of a photoflash lamp in accordance with a preferred embodiment of the invention.

The lamp shown in FIG. 1 of the drawing is generally the same as that shown in FIG. 5 of U.S. Pat. No. 3,506,385 to Kurt Weber and George Cressman, and comprises a tubular envelope 11, preferably made of a borosilicate glass or other suitable vitreous material having a stem press seal 12 at one end thereof through which a pair of lead-in wires 13, 14 extend from the exterior to the interior of the bulb 11 in a mutually parallel spaced-apart manner.

A support bead 16 of glass or other suitable vitreous material secures the lead-in wires 13 and 14 in spaced apart relationship within the bulb 11, and a filament 19 coated with suitable primer ignition material is held near the ends thereof by the ends of the lead-in wires 13 and 14 within the bulb 11. Alternatively, primer material may be applied over the ends of the lead-in wires within the bulb, instead of or in addition to being coated on the filament 19. The support bead 16 is not required for the purposes of the invention. The bulb 11 is substantially filled with a loose mass of filamentary or shredded metal wire or foil 21 of zirconium or hafnium or other suitable combustible metal. Air is exhausted from the bulb 11, and the bulb is filled with oxygen at a pressure of at least several atmospheres, such as about 5 to 10 atmospheres, and the bulb is sealed off at an exhaust tip 22 at the upper end thereof. The lamp may be coated with the usual lacquer or plastic protective coating. A flash lamp having a filament as shown is a so-called low voltage type and can be flashed with only a few volts of electricity. Alternatively, the lamp can be a so-called high voltage type having, instead of a filament, primer material bridging across the lead-in wires and requiring hundreds or thousands of volts (at low energy) for ignition.

In accordance with the invention, a plurality of small beads 23 are provided inside the bulb 11 near the bottom thereof, and surrounding at least one of the lead-in wires 13, 14 for at least a part of its distance of inwardly extension into the bulb. In the embodiment of FIG. 1, the small beads occupy the bottom portion of the bulb up to the support bead 16, and in the embodiment of FIG. 2, the small beads 23 fill the lower part of the bulb up to near the filament 19.

Figure 2:
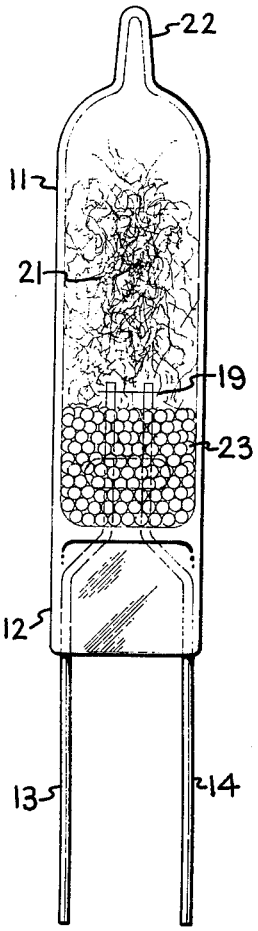
FIG. 2 is a side view of a photoflash lamp in accordance with an alternative embodiment of the invention.

When the lamp is flashed, the combustible metal 21 burns, and occasionally fails to burn completely, whereby particles of unburned or partly burned metal fall to the bottom of the bulb. In accordance with the invention, the plurality of small glass beads 23 prevents these metal particles from accumulating on the bottom of the bulb and short-circuiting, or partially shorting, across the lead-in wires within the lamp. In the embodiment of FIG. 1, the metal particles tend to slide off the curved upper surface of the support bead 16, and the small beads 23 catch these particles and prevent them from reaching the lead-in wires. In the embodiment of FIG. 2, the irregular upper surface provided by the small beads 23 tends to catch and trap the metal particles at various angles, thus preventing them from lying flat across and between the upper ends of the lead-in wires, and thus prevents shorting from occurring.

The plurality of small beads 23 may be poured or inserted into the bulb 11 after the lead-in wires 13, 14 have been sealed into the base 12, whereupon the combustible metal 21 is inserted into the bulb 11. In the embodiment of FIG. 2, the shredded metal foil 21 substantially occupies the interior of the bulb not occupied by the small beads 23, thereby holding the beads 23 in position at the bottom portion of the bulb 11. In manufacturing the embodiment of FIG. 1, it may be desirable to mix a liquid binder with, or pour it over, the plurality of small glass beads 23, the binder preferably being in liquid form when applied, which then is dried and evaporated, leaving at least the upper layer of the small beads 23 adhered together by the adhesive material. A suitable binder solution is nitrocellulose resin in amyl acetate. If a lead-in support bead 16 is employed, the small short-preventing beads 23 should be of a size small enough so that they will fit in the space between the support bead 16 and wall of the bulb 11 as they drop into place below the support bead 16.

Figure 3:
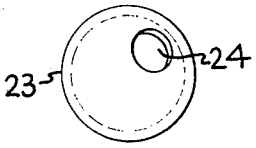
FIG. 3 is a perspective view of a hollow spherical bead having an opening through the wall thereof, which may be used in the embodiments of FIGS. 1 and 2.
Figure 4:
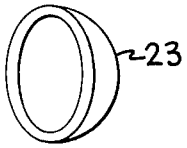
FIG. 4 is a perspective view of a cup-like hollow hemispherical bead member which may be used in the embodiments of FIGS. 1 and 2.

Although the plurality of beads 23 occupy some space within the bulb that would otherwise be occupied by oxygen, and hence reduce the amount of oxygen fill that can be placed within the bulb at a given pressure, this is a trade-off in exchange for the after-flash short-preventing feature achieved by the invention. However, since the oxygen can occupy spaces between and among the beads 23, the reduced amount of oxygen fill is not as great as if the beads were replaced by a solid material. If the beads 23 are hollow and provided with one or more openings 24 as shown in FIG. 3, the presence of the beads 23 in the bulb 11 will not substantially reduce the amount of volume available for the oxygen gas fill. This advantage can also be achieved by providing the beads in a cup-shaped form such as a hollow hemisphere as shown in FIG. 4.

Although the small beads 23 are shown as being spherical or hemispherically shaped, they may be square, irregular, or any other shape which achieves the objectives of the invention. The invention is a feasible and economical construction of a flash lamp which is desired to be an open circuit, or high impedance such as a few hundred ohms or more, internally thereof between the lead-in wires after being flashed.

While preferred embodiments of the invention have been shown and described, various other embodiments and modifications thereof will become apparent to persons skilled in the art and will fall within the scope of the invention as defined in the following claims.

What I claim as new and desire to secure by Letters Patent of the United States is:

1. A photoflash lamp of the type comprising a bulb having a base, a pair of lead-in members extending through said base and into said bulb, and flash initiation means connected between said lead-in members within said bulb, said bulb containing combustible material ignitable by said flash initiation means, wherein the improvement comprises a plurality of bead members of electrically insulative material positioned within said bulb near siad base thereof and around at least one of said lead-in members thus reducing the possiblity of shorting between the lead-in members.

2. A lamp as claimed in claim 1, in which said combustible material engages against the upper surface of said bead members and holds said plurality of bead members in position.

3. A lamp as claimed in claim 1, including an adhesive material on at least the uppermost of said bead members thereby holding said plurality of bead members in place.

4. A lamp as claimed in claim 1, in which said bead members have spherical shapes.

5. A lamp as claimed in claim 1, in which said bead members are hollow and have one or more openings through the walls thereof.

6. A lamp as claimed in claim 1, in which said bead members are cup-shaped.

7. A lamp as claimed in claim 6, in which said bead members are hollow hemispheres.

8. A lamp as claimed in claim 1, in which said plurality of bead members extends upwardly from said base to near said flash initiation means.

9. A lamp as claimed in claim 1, including a support bead sealed to said lead-in members at a position between said base and said flash initiation means, said plurality of beads extending in said bulb from said base to said support bead.

10. A lamp as claimed in claim 1, in which said plurality of bead are made of glass.

11. A method of making a photoflash lamp, comprising the steps of providing a bulb, sealing lead-in members through a base of said bulb, placing a plurality of bead members in said bulb and onto said base and around at least one of said lead-in members, placing combustible material in said bulb and over said plurality of bead members, providing a combustion-supporting gas in said bulb, and sealing the bulb.

12. A method as claimed in claim 11, in which said combustible material is positioned against the top of said plurality of bead members thereby holding them in position in the finished lamp.

13. A method as claimed in claim 11, including the step of combining an adhesive material with said bead members to hold them in place.

14. A method as claimed in claim 11, including the step of providing a support bead sealed to said lead-in members at a position spaced from said base of the bulb and spaced from the wall of the bulb, said plurality of bead members being sufficiently small in size to pass between said support bead and said wall of the bulb.

* * * * *